US010893576B2

(12) United States Patent
Strecker

(10) Patent No.: US 10,893,576 B2
(45) Date of Patent: Jan. 12, 2021

(54) HEATING SYSTEM FOR A GARMENT OR OTHER FABRIC OBJECT AND POWER CONTROL FOR EMBEDDED POWERED COMPONENTS

(71) Applicant: TEIIMO GMBH, Gilching (DE)

(72) Inventor: Markus Strecker, Herrsching (DE)

(73) Assignee: Teiimo GmbH, Gilching (DE)

( * ) Notice: Subject to any disclaimer, the term of this patent is extended or adjusted under 35 U.S.C. 154(b) by 656 days.

(21) Appl. No.: 15/516,320

(22) PCT Filed: Oct. 2, 2015

(86) PCT No.: PCT/IB2015/002113

§ 371 (c)(1),
(2) Date: Mar. 31, 2017

(87) PCT Pub. No.: WO2016/051278

PCT Pub. Date: Apr. 7, 2016

(65) Prior Publication Data

US 2017/0332442 A1 Nov. 16, 2017

Related U.S. Application Data

(60) Provisional application No. 62/058,980, filed on Oct. 2, 2014.

(51) Int. Cl.
*H05B 1/02* (2006.01)
*H05B 3/34* (2006.01)
(Continued)

(52) U.S. Cl.
CPC ..... *H05B 1/0272* (2013.01); *A41D 13/0051* (2013.01); *H05B 3/34* (2013.01);
(Continued)

(58) Field of Classification Search
CPC ..... A41D 13/0051; H05B 3/34; H05B 1/00; H05B 2203/036; H05B 1/0272
(Continued)

(56) References Cited

U.S. PATENT DOCUMENTS 2,579,383 A * 12/1951 Goudsmit ..... H05B 3/342 219/211
3,084,241 A * 4/1963 Carrona ..... H05B 3/342 219/211
(Continued)

FOREIGN PATENT DOCUMENTS

| | | | |
|---|---|---|---|
| EP | 0985354 | A1 | 3/2000 |
| WO | 03107721 | A1 | 12/2003 |
| WO | 2005034663 | A1 | 4/2005 |

OTHER PUBLICATIONS

International Search Report and Written Opinion for International Application No. PCT/IB2015/002113, dated May 6, 2016—18 Pages.

*Primary Examiner* — Jimmy Chou
(74) *Attorney, Agent, or Firm* — RatnerPrestia

(57) ABSTRACT

A heating system, such as embedded in a fabric object, such as a wearable garment, comprising at least one heating element comprising an electrical resistance heating loop, the heating element comprising at least one sense wire for detecting and providing a signal indicative of a safety condition, and a controller connected to the at least one heating element and to the sense wire and configured to shut down the heating element in response to the signal indicative of the safety condition. Multiple, independently controllable heating elements in a garment may be connected to a harness and one or more integral battery packs with a power management system to permit hot swapping of the battery packs. The garment may be configured to be communicatively
(Continued)

paired to a mobile device to provide hands free phone, music streaming, and/or a user interface for the heating system.

19 Claims, 5 Drawing Sheets

(51) Int. Cl.
*A41D 13/005* (2006.01)
*H05B 1/00* (2006.01)
*H05B 3/00* (2006.01)

(52) U.S. Cl.
CPC ..... *H05B 1/00* (2013.01); *H05B 3/00* (2013.01); *H05B 2203/036* (2013.01)

(58) Field of Classification Search
USPC ..... 219/212, 543, 544, 549, 545, 528, 529, 219/516
See application file for complete search history.

(56) References Cited

U.S. PATENT DOCUMENTS 3,392,264 A * 7/1968 Stanley ..... A43B 3/0005 219/211
3,407,818 A * 10/1968 Costanzo ..... A61F 7/007 607/108
3,500,014 A * 3/1970 Longo ..... H05B 3/342 219/211
3,501,616 A * 3/1970 Arron ..... H05B 3/342 219/211
3,839,621 A * 10/1974 Hariu ..... A61F 7/007 219/211
3,999,037 A * 12/1976 Metcalf, Sr. ..... H05B 3/342 219/211
4,061,897 A * 12/1977 Thykeson ..... A61F 7/007 219/211
4,279,255 A * 7/1981 Hoffman ..... A61F 7/007 219/211
4,404,460 A * 9/1983 Kerr ..... A41D 13/0051 2/69
4,532,410 A * 7/1985 Wehmeyer ..... A41D 23/00 219/211
4,547,658 A 10/1985 Crowley
4,677,281 A * 6/1987 Mills ..... H02H 5/043 219/212
4,979,502 A * 12/1990 Hunt ..... A61H 23/02 601/15
5,032,705 A * 7/1991 Batcheller ..... A41D 13/0051 219/211
5,073,688 A * 12/1991 McCormack ..... H05B 3/342 219/212
5,148,002 A * 9/1992 Kuo ..... H01Q 1/273 219/211
5,302,806 A * 4/1994 Simmons ..... A41D 13/0051 219/211
5,436,429 A * 7/1995 Cline ..... A47J 36/2433 219/202
5,824,996 A * 10/1998 Kochman ..... A41D 13/0051 219/529
5,893,991 A * 4/1999 Newell ..... A41D 13/0051 219/211
5,900,720 A * 5/1999 Kallman ..... G02F 1/163 320/103
5,974,820 A * 11/1999 Boyd ..... B65D 81/3886 219/529
5,986,243 A * 11/1999 Campf ..... A41D 13/0051 219/211
6,000,395 A * 12/1999 Brown ..... A41D 13/0051 128/201.29
6,049,062 A * 4/2000 Jones ..... A41D 13/0051 219/211
6,160,246 A 12/2000 Rock et al.
6,294,768 B1 * 9/2001 Liebich ..... H05B 3/36 119/526
6,313,438 B1 * 11/2001 Emerick, Jr. ..... A47G 9/086 2/69
6,353,211 B1 * 3/2002 Chen ..... H05B 3/342 219/211
6,439,942 B1 * 8/2002 Pillai ..... A41D 13/0051 2/905
6,561,814 B2 * 5/2003 Tilbury ..... A41D 1/005 2/102
6,958,463 B1 * 10/2005 Kochman ..... H05B 3/56 219/494
6,969,831 B1 * 11/2005 Parker ..... H05B 3/342 219/212
7,034,251 B1 * 4/2006 Child ..... H05B 3/342 219/212
7,064,292 B1 * 6/2006 Oishi ..... B62J 33/00 219/202
7,769,412 B1 * 8/2010 Gailloux ..... H04M 1/05 455/419
7,816,628 B2 * 10/2010 Fernandez ..... A41D 13/0051 219/200
8,008,606 B2 * 8/2011 Kaiserman ..... A43B 7/04 219/211
8,370,965 B2 * 2/2013 Lin ..... B82Y 30/00 2/93
8,648,280 B1 * 2/2014 DeWitt ..... A47C 21/048 219/212
8,756,716 B2 * 6/2014 Jordan ..... A41D 1/002 2/247
9,044,867 B2 * 6/2015 Rothschild ..... B62B 9/00
9,161,393 B2 * 10/2015 Kaiserman ..... A43B 3/0005
9,364,030 B1 * 6/2016 Aiello ..... A41C 3/005
D787,160 S * 5/2017 Crowe ..... D2/750
D794,281 S * 8/2017 Crowe ..... D2/829
D799,161 S * 10/2017 Crowe ..... D2/828
D808,125 S * 1/2018 Crowe ..... D2/828
9,956,112 B2 * 5/2018 van Oudenallen ..... A61F 7/02
9,963,210 B1 * 5/2018 Ebot ..... A41D 13/0051
10,178,882 B2 * 1/2019 Yue ..... A41D 13/0051
2002/0088788 A1 * 7/2002 West ..... H05B 3/342 219/211
2002/0153367 A1 * 10/2002 Haas, Jr. ..... A41D 13/0051 219/543
2003/0218004 A1 * 11/2003 Yoneyama ..... H05B 3/34 219/528
2004/0004070 A1 * 1/2004 Sullivan ..... H05B 3/36 219/494
2004/0256381 A1 * 12/2004 Haas ..... A61F 7/007 219/543
2005/0007406 A1 * 1/2005 Haas ..... A41D 13/0051 347/17
2005/0037241 A1 * 2/2005 Schneider ..... G06F 1/263 429/9
2005/0263518 A1 12/2005 Weiss
2006/0051079 A1 * 3/2006 Gerhardinger ..... A47K 10/06 392/435
2006/0060576 A1 * 3/2006 Haas ..... H05B 3/342 219/543
2006/0080756 A1 * 4/2006 Goldfine ..... A41D 13/0051 2/102
2006/0151475 A1 * 7/2006 Horvath ..... F24D 13/02 219/529
2006/0166082 A1 * 7/2006 Turner ..... H01M 2/1055 429/96
2006/0213895 A1 * 9/2006 Dennis ..... A41D 13/0051 219/211
2006/0261055 A1 * 11/2006 Child ..... H05B 3/342 219/212
2007/0045269 A1 * 3/2007 Vassallo ..... H05B 3/342 219/211
2007/0084843 A1 * 4/2007 Caldwell ..... H05B 3/36 219/211
2008/0023460 A1 * 1/2008 Huang ..... A41D 13/0051 219/211

(56) References Cited

U.S. PATENT DOCUMENTS

2008/0067163 A1* 3/2008 Axinte ..... A01K 13/006 219/211
2008/0083720 A1* 4/2008 Gentile ..... A43B 3/0005 219/211
2008/0083721 A1* 4/2008 Kaiserman ..... A43B 3/0005 219/211
2008/0116189 A1* 5/2008 Fernandez ..... A41D 13/0051 219/211
2008/0223844 A1* 9/2008 Cronn ..... A41D 13/0051 219/211
2008/0237209 A1* 10/2008 Gibbons ..... A61F 7/007 219/211
2009/0057288 A1* 3/2009 Chen ..... H05B 3/342 219/211
2009/0271917 A1* 11/2009 Richardson ..... A41D 13/0025 2/458
2009/0289046 A1* 11/2009 Richmond ..... A41D 13/0051 219/211
2010/0193503 A1* 8/2010 Kim ..... H05B 3/56 219/494
2010/0199405 A1* 8/2010 Nelson ..... A41D 13/0051 2/102
2011/0108538 A1* 5/2011 Gray ..... H05B 1/0272 219/211
2011/0215086 A1* 9/2011 Yeh ..... F21V 23/02 219/488
2012/0061371 A1* 3/2012 Broom ..... A63C 11/222 219/211
2012/0074128 A1* 3/2012 Blackford ..... A41D 13/0051 219/487
2012/0091115 A1* 4/2012 Mironichev ..... H02J 7/0014 219/211
2012/0228279 A1* 9/2012 Haas ..... H05B 3/845 219/211
2012/0318781 A1* 12/2012 Lavin, Jr. ..... A41D 13/005 219/211
2013/0001212 A1* 1/2013 Mangoubi ..... H05B 1/0272 219/211
2013/0020304 A1* 1/2013 Zainzinger ..... H05B 3/345 219/211
2013/0037531 A1* 2/2013 Gray ..... H05B 1/0272 219/211
2013/0168380 A1* 7/2013 Wang ..... H05B 1/0272 219/497
2013/0233843 A1* 9/2013 Hoberty ..... A41D 23/00 219/211
2013/0306614 A1* 11/2013 Fey, Jr. ..... A41D 1/00 219/211
2014/0021189 A1* 1/2014 Yue ..... A41D 1/005 219/211
2014/0061273 A1* 3/2014 Bullivant ..... A45F 3/04 224/576
2014/0158673 A1* 6/2014 Gou ..... H05B 1/0272 219/211
2014/0246416 A1* 9/2014 White ..... H05B 3/342 219/211
2014/0326708 A1* 11/2014 Barfuss ..... B60N 2/5685 219/204
2014/0353300 A1* 12/2014 Swiatek ..... H05B 1/0272 219/211
2015/0060430 A1* 3/2015 Tsuge ..... H05B 1/0272 219/211
2015/0083704 A1* 3/2015 Guidry ..... A41D 19/01535 219/211
2015/0083705 A1* 3/2015 Cronn ..... H05B 3/347 219/211
2015/0122791 A1* 5/2015 Hung ..... H05B 1/0272 219/211
2015/0136753 A1* 5/2015 Cronn ..... A41D 13/0051 219/211
2015/0230524 A1* 8/2015 Stevens ..... H05B 1/0272 219/211
2015/0382402 A1* 12/2015 Chen ..... A41D 13/0051 219/211
2016/0050716 A1* 2/2016 Peng ..... H05B 1/0272 219/494
2016/0128393 A1* 5/2016 Janda ..... A41D 13/0051 219/211
2016/0198777 A1* 7/2016 Baker ..... A41D 13/0051 219/211
2017/0013677 A1* 1/2017 Chen ..... H05B 3/342
2017/0332442 A1* 11/2017 Strecker ..... A41D 13/0051
2018/0103694 A1* 4/2018 Fortenbacher ..... A41D 13/0051

* cited by examiner

HEATING SYSTEM FOR A GARMENT OR OTHER FABRIC OBJECT AND POWER CONTROL FOR EMBEDDED POWERED COMPONENTS

CROSS-REFERENCE TO RELATED APPLICATIONS

This application is the National Stage filing of International Appln. No. PCT/IB2015/002113, filed 2 Oct. 2015, and claims priority from U.S. Provisional Application Ser. No. 62/058,980, filed Oct. 2, 2014, titled "JACKET WITH EMBEDDED TECHNOLOGY," the entirety of which applications are incorporated herein by reference for all purposes.

BACKGROUND OF THE INVENTION

Garments and other fabric items with embedded heaters or other powered components are known, but there is a need for a combination of improved comfort and control of heated garments, such as jackets, as well as an interest in providing additional controllable conformable technology integrated therein, and for control of powering the powered components.

SUMMARY OF THE INVENTION

One aspect of the invention comprises a heating system comprising at least one heating element comprising an electrical resistance heating loop, at least one sense wire for detecting and providing a signal indicative of a safety condition, and a controller connected to the at least one heating element and to the sense wire, the controller configured to shut down the heating element in response to the signal indicative of the safety condition. In one embodiment, the at least one heating element comprises a bundle of wire strands, the bundle including at least one heater wire strand and the at least one sense wire strand. In particular, the at least one sense wire strand may have an insulator covering the wire and the at least one heater wire strand may be uninsulated, with the at least one sense wire electrically connected to the at least one heater wire at a break in the insulator covering of the at least one sense wire. In another embodiment, the at least one sense wire strand is characterized by a resistance having a non-linear response to temperature, such that a hot spot of a predetermined temperature in the heating wire adjacent the at least one sense wire strand causes the non-linear response to change the resistance of the wire in an amount detectable by the controller, thereby providing the signal indicative of the safety condition.

Another aspect of the invention comprises fabric objects having an embedded heating element as described and claimed herein, such as a car seat or a planar sheet is sufficiently flexible to conform to a planar or non-planar surface, such as but not limited to, a wall hanging such as wallpaper, a rug, a towel.

Yet another aspect of the invention comprises a garment, such as a jacket, comprising an embedded heating element as described and claimed herein. In particular, the garment or other fabric object comprises a plurality of heating zones, each zone comprising at least one respective, independently controllable, heating element. Certain embodiments may further comprise one or more integral power sources integrated into the garment, each integral power source removable, rechargeable, and connected to an interface configured to be connected to remote power source, and a harness connected to the one or more integral power sources and the one or more independently controllable heating elements. The one or more integral power sources may comprise at least two power sources electrically connected to at least one power controller, the at least one power controller configured to regulate charging and discharging of the power sources, the power controller configured to control an exchange of power between the power sources when each power source has a different electrical potential from the other.

Each of the at least two power sources may comprise a battery pack, and the at least one power controller may comprise a circuit connected to each battery pack, the circuit comprising a switch activated to permit the battery pack to supply energy to the system when voltage outside the battery is lower than inside the battery. The garment or other fabric object may comprise at least one input port configured to receive power from an external power source other than from the battery packs, and to charge the battery packs from the external power source. The at least one power controller is configured to control whether each battery charges or does not charge when the system is connected to the external power source. In particular, a garment may have a power control system configured to permit continuous operation when fewer than all of the at least two integral power sources are disconnected and when connecting or disconnecting from the external power source.

Another aspect of the invention comprises each of at least two power sources, as described herein, disposed in a pocket stitched into a garment in a location adjacent the upper arm of a wearer when the garment is worn by the wearer, the pocket located between the inner layer and the outer layer and attached to the garment at a seam adjacent a shoulder of the wearer and accessible from an opening into the pocket from the outer layer.

In yet another aspect of the invention, the system may comprise at least one light operable to blink in a characteristic pattern when the system is operating, the at least one light powered by an energy harvester positioned to harvest electrical power from the harness.

Some garment embodiments may further comprises an audio system comprising a microphone integrated into the garment in a location configured to align adjacent to a source of vocalization emitted by the wearer when the jacket is worn by the wearer, one or more speakers integrated into the jacket in locations configured to align adjacent with ears of the wearer when the jacket is worn by the wearer, and a communications module connected to the audio system configured to exchange a wireless communication signal with a mobile device adapted to be communicatively paired to the jacket, the wireless communications signal corresponding to audio signals transmitted to the speakers and received from the microphone. A user interface integrated into the garment may be configured for controlling the audio system via one or more buttons operable by force exerted on the external layer of the garment.

One user interface embodiment operable to control the heat control system comprises a computer software application residing at least in part on the mobile device adapted to be communicatively paired to the communications module of the garment. The communications signal exchanged with the mobile devices further comprising one or more control signals transmitted to the heat controller or one or more monitoring signals transmitted from the heat controller, wherein each heating element is configured to provide heat to the heating zone at one of a plurality of heat levels, including a full power level, a no power level, and at least one intermediate power level. The computer software application may be configured to receive a command signal transmitted to the mobile device, the computer software application programmed to respond to the command signal by sending information in the communications signal exchanged with the communications module of the garment instructing one or more of the plurality of heating zones to activate in a characteristic warming pattern.

A user interface operable to control the heat control system comprising a controller physically connected to the garment may comprise a plurality of buttons including at least one button for controlling each independently controllable heating elements, each heating element configured to provide heat to the heating zone at one of a plurality of heat levels, including a full power level, a no power level, and at least one intermediate power level.

In one embodiment of the heating system, the electrical resistance heating loop has a first end and a second end and comprises at least two heater wires defining a path having a length between respective first ends connected to the controller and respective second ends connected to each other. The at least one sense wire may be connected to the heating loop at a location between the first end and the second end of the heating loop, which location may be at a distance from the first end of the heating loop in a range of between one third to two thirds of the path length, and more preferably at approximately half the path length.

In another embodiment, the at least two heater wires may define a single sinuous path that outlines an area, with the at least one sense wire positioned in the area and disposed essentially parallel to the sinuous path defined by the heater wires. The at least one sense wire may comprise a first sense wire that defines a path parallel to a first heater wire of the at least two heater wires, and a second sense wire that defines a path parallel to a second heater wire of the at least two heater wires. The first and second sense wires may be connected at respective first ends to the controller and at respective second ends to an interconnect, wherein the interconnect is configurable to switch between a relatively lower resistance connection and a relatively higher resistance connection. The controller may be configured to test the consistency of the sense wires when the interconnect is configured with the relatively lower resistance connection and to detect moisture when the interconnect is configured in the relatively higher resistance connection.

In preferred embodiments, the heater wires comprise stainless steel, preferably in bundles comprising a plurality of at least two individual strands braided or woven together to form the wire. The wire harness comprises a bus configured to transmit electrical power and electrical data signals.

Another aspect of the invention comprises a garment with any type of embedded powered components, not limited to heaters, the garment comprising one or more powered components embedded in the garment, at least two removable, rechargeable power sources integrated into the garment and electrically connected to the one or more powered components, and at least one power controller electrically connected to at least two integral power sources. The power controller is configured to regulate charging and discharging of the power sources and configured to control an exchange of power between the power sources when each power source has a different electrical potential from the other. In one embodiment, each of the at least two power sources comprises a battery pack, and the at least one power controller comprises a circuit connected to each battery pack, the circuit comprising a switch activated to permit the battery pack to supply energy to the system only when voltage outside the battery is lower than inside the battery. The system preferably also comprises at least one input port configured to receive power from an external power source other than from the battery packs and to charge the battery packs from the external power source. In such a system, the power controller may be configured to control whether each battery charges or does not charge when the system is connected to the external power source or to permit continuous operation when fewer than all of the battery packs are disconnected and when connecting or disconnecting from the external power source.

DETAILED DESCRIPTION OF THE INVENTION

Figure 1:
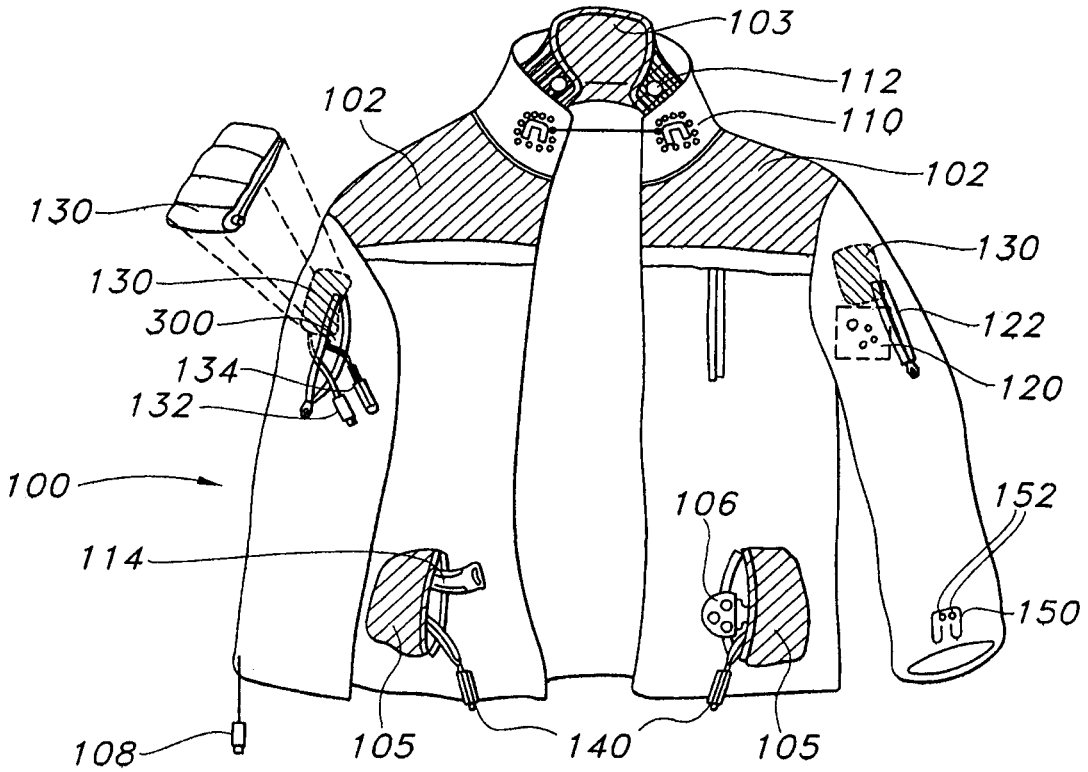
FIG. 1 is a depiction of the front view of an exemplary jacket embodiment of the invention, showing exemplary heated zones and various components.

Referring now to the figures, one embodiment of the invention described herein comprises an exemplary wearable electronics system integrated into a leather jacket 100, but it should be understood that the most if not all of the features described herein are applicable to any wearable garment, as well as to any product made from cloth, textile, fabric, leather, fur, skin, suede, or the like, such as rugs, blankets, linens, etc. The term "fabric" as used herein is not limited to any particular type of cloth or textile or type of materials, and is intended to include any type of material, man-made or naturally occurring, that is fashionable into a cloth-like structure for incorporating into a garment, rug, blanket, linen, etc. As used in the exemplary jacket, the main function of the integrated electronics is to provide warmth to the wearer. Therefore, the exemplary jacket provides two independently controllable heating zones: a first zone 102 providing warmth to the upper back, the shoulders (back and front) and via the collar 103 to the neck, and a second zone 104 providing warmth to the lower back and the kidneys, which second zone may extended to pocket heaters 105, such as for a women's jacket. Of course, the invention is not limited to any particular number of zones, locations of heaters, or locations included in a particular zone, or type of garment containing such zones.

As depicted herein, one user interface 106 for controlling the heating zones and switching the electronics of the jacket on and off is located in the lower left pocket of the jacket, but may be located in any pocket or in any other inconspicuous location accessible to the user. In some embodiments, one or more auxiliary interconnects 108 may be provided to power accessories for use with the jacket. For example, an auxiliary interconnect (not shown) may be provided around or at the upper collar or a suitable location to provide power to an accessory (such as, for example, a hat, a scarf, etc.). A second auxiliary interconnect 108 may be placed at the end of the sleeves to power an accessory, such as gloves mittens, etc.; a third accessory interconnect (not shown) may be located around the waist level and to serve additional auxiliary heating elements.

Another aspect of the invention comprises a hands free wireless implementation for a mobile device, such as provided using Bluetooth® technology. Although referred to herein as a Bluetooth® link, it should be understood that the wireless link is not limited to any particular technology. The exemplary jacket provides a communications module 122 configured to provide the Bluetooth® link to a mobile phone, so that the jacket itself essentially serves as a hands free headset, and allows for music streaming. In the exemplary system, two integrated speakers 110 are located in the outer collar and a microphone 112 is located in the inner collar, and a control interface 120, comprising a plurality of buttons for answering the phone, hanging up the phone, controlling volume, without limitation, located in the upper left sleeve. The exemplary jacket further provides the ability to charge a mobile phone or power a USB device, such as by providing, for example, a 5V output to the user via a standard USB plug 114 integrated in a pocket.

For its power supply, the exemplary jacket provides two removable rechargeable batteries 130 located in the upper sleeves. An electronics control unit permits charging the batteries in the jacket and using them in parallel. To facilitate use in a car, the jacket has a power plug 140 in each of the lower side pockets configured to be connected via an interface cable to an external power source, such as for example, the 12V plug of a car. The same plugs can be connected to a power supply that is connected to the 110/230V grid. If the jacket is switched "off," the controls are programmed or otherwise configured to charge the batteries from such a power connection. As an iconic recognition feature, the jacket may have a logo 150 integrated in the lower area of the left (or right) sleeve that includes two lights 152 that serve as dots on the double lowercase i's in the logo depicted herein. The two lights may, for example, glimmer on and off in a slow interval from time to time when the jacket is active. In a preferred embodiment, the appearance of the logo is black when the lights are not activated.

Garment Structure

Figure 2:
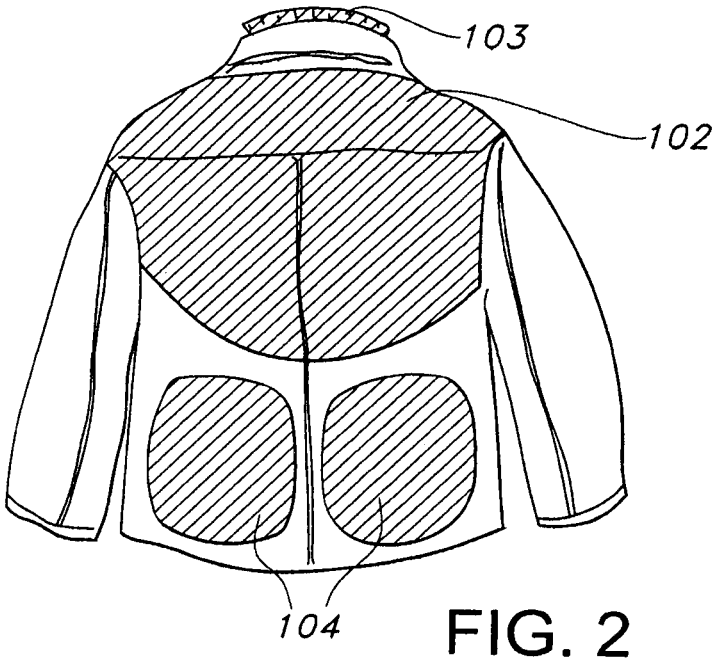
FIG. 2 is a depiction of the rear view of the exemplary jacket embodiment of FIG. 1, showing exemplary heated zones.
Figure 3:
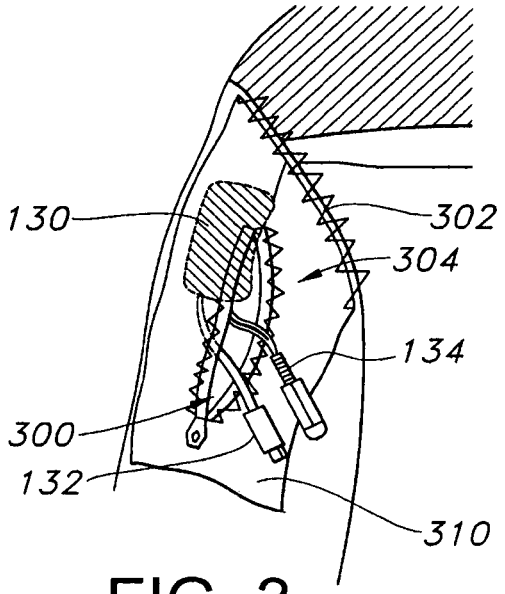
FIG. 3 is a depiction of an exemplary battery pocket design.

The main structure of jacket 100 comprises an outer shell (visible in FIGS. 1 and 2) and an inner shell or liner (not shown). The electronics and the harness are mainly located between the inner and the outer shell. The location of all electronic elements and the harness is such that it is barely felt by the user in a normal use scenario. In particular, the jacket is tailored to provide support for the weight of the batteries from the user's shoulder so that the weight of the battery is not as apparent to the user's arms. In an exemplary embodiment, this tailoring comprises the structure shown in FIG. 3, namely special pockets 300 disposed between the jacket lining and the jacket outer layer, in which each battery 130 resides. Each pocket lining 310 is attached to the jacket lining and outer layer only (a) at the seam 302 that goes across the user's shoulders and (b) at the zippered opening 304 to the pocket from the outer layer. In this way, the weight of the battery pocket is supported from on top of the user's shoulder, and is perceived by the user as part of the overall weight of the sleeve, rather than as a discrete lump supported between the user's shoulder and elbow.

Thus, in summary, each of the at least two power sources may be disposed in a pocket stitched into the garment in a location adjacent the upper arm of a wearer when the garment is worn by the wearer, the pocket located between an inner layer and an outer layer of the garment and attached to the garment at a seam adjacent a shoulder of the wearer and accessible from an opening into the pocket from the outer layer.

The heating controller electronics 808 (not shown in FIG. 1) may be located in the right side just under the arms. It contains textile connections to the heating elements as well as to all other devices. It is made such that it can be disconnected from the textile harness. The defined interconnect points in the textile harness allow for easy repairs and a final system test of the components before inserting the central control electronics (i.e. the heating control unit). The heating control unit communicates with the Bluetooth module, the user interface, and the battery modules, and it controls the heating elements, the signature sign and collects the information from all the sensors.

The Bluetooth main electronics 120 and an audio amplifier are located in the same area as the upper left battery and the user interface 122 is on the back of the Bluetooth elements. The audio amplifier preferably comprises, for example, a 1 W output for each channel in a stereo configuration.

The mobile device charger 114 may be located in the right inner pocket of the women's jacket and in the lower outer pocket of the men's jacket. The chargers are preferably positioned far away from a natural resting position of the hand in the pocket, and these pockets for holding the mobile phone may be shielded with electromagnetic shielding textiles to minimize radiation from the phone being transmitted to the body of the user.

The indicator light or lights 152, such as the ornamental sign 150, is connected to the main heating electronics and may be glued to the outer shell of the harness.

The microphone 112 is located in the inner collar and protected by the inner collar. The speakers 110 are located in the outer collar and the leather is pierced at the location of the speakers in order to allow the sound to penetrate the leather easier.

The exemplary jacket provides warmth and the ability to use the mobile phone while driving in a classic or antique car that may not have all of the traditional electronics of a modern car. The exemplary jacket may also be particularly useful for wearing in a convertible car, modern or older, with the convertible roof down. The exemplary is configured to provide heat to the upper back and the shoulder as well as the collar and to provide warmth with the user having to wear a bulky winter jacket. On demand it can provide heat to the lower back and/or kidneys as well. The exemplary jacket can also efficiently provide comfort similar to that of a heated car seat, but with more energy efficiency. The close contact of the jacket with the body leads to a more efficient heat transfer to the body as compared to a heated car seat and saves energy. The upper heating zone provides warmth where a typical car seat does not provide heat. Some modern cars have integrated "air scarfs" to provide warm air around the head, but the energy efficiency of the exemplary jacket is superior to such system. The two zone implementation allows a user with a heated seat to use the heated seat in combination with only the upper heating zone in the jacket, in the location where the heated seat may not be able to provide heat. In some embodiments, such as a women's jacket configuration, the exemplary jacket may provide a heated pocket controlled together with the lower back heating zone. The pockets provide warmth to the hands when they rest in the pockets.

While illustrated in embodiments having two or more independently controlled heating zones, the jacket is not limited to any particular number of independently controlled zones, and may have only a single zone, or more than two zones.

While the exemplary jacket is useful in connection with a car, motorcycle, or other powered vehicle, the jacket is not limited to any particular use, and may also be useful for a wearer on a bicycle, on a walk, or when stationary. The ability for the jacket to provide "on demand" heat may be particularly useful for providing an added level of comfort when the user is more exposed, such as to wind from a moving vehicle, or when the user goes from being engaged in physical exertion to not being engaged, such as after a walk or a bike ride.

Heating

Figure 5:
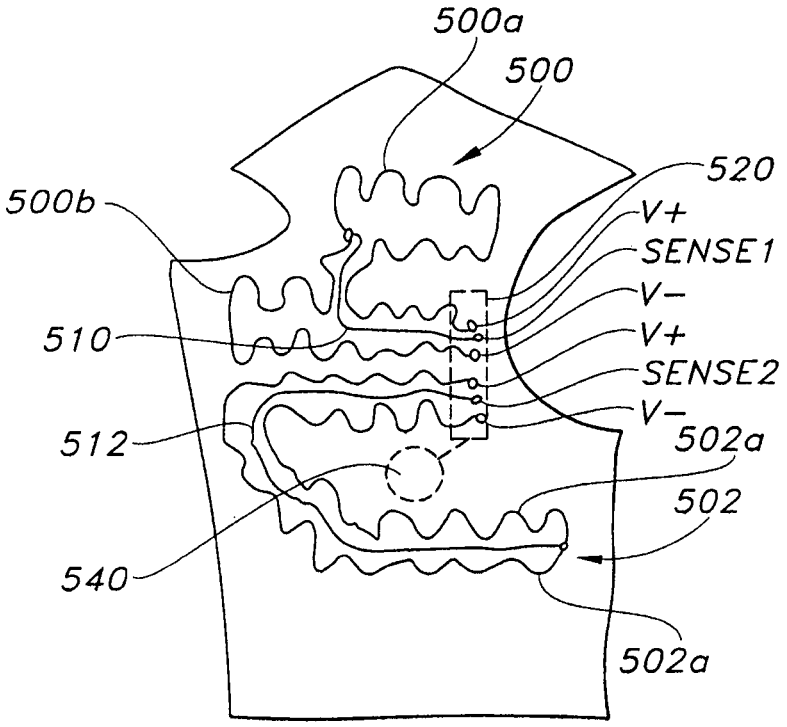
FIG. 5 is a schematic drawing of an exemplary heating element with an exemplary sense wire embodiment.
Figure 6:
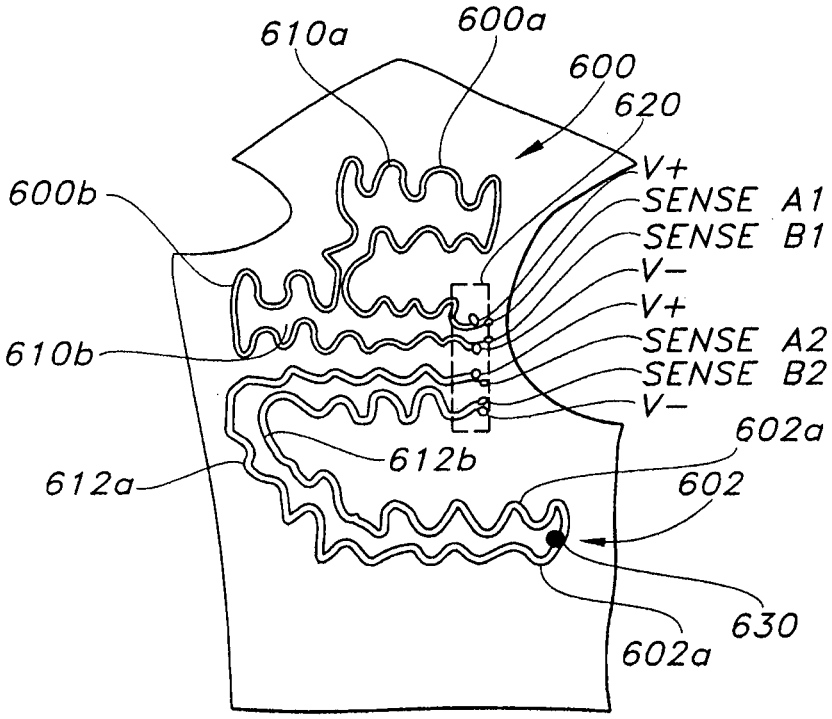
FIG. 6 is a schematic drawing of the exemplary heating element with another exemplary sense wire embodiment.
Figure 8:
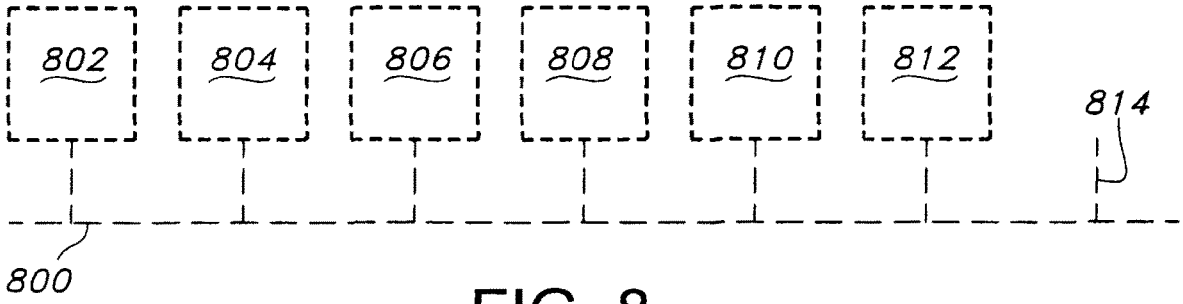
FIG. 8 is a schematic depiction of the wire harness bus for an exemplary jacket embodiment.

Referring now specifically to FIGS. 5, 6, and 8 the heat in the exemplary jacket may be provided by an electrical resistance heating system 800 controlled by a heat controller embedded 802 into the jacket. Integrated temperature sensors 804 check the heat provided, and may provide a read out on a display attachable or detachable (to permit cleaning) to the jacket (not shown), or preferably, wirelessly via Bluetooth® technology via a mobile application 702 downloadable to a mobile device 700, such as a mobile phone, tablet or other computing device having Bluetooth® capabilities. One function of the sensors is to detect and respond to overheating in use. For example, the electronics may sense 3 points in the jacket and measure the temperature. Should the temperature be abnormally high, the electronics can shut the heating elements off.

A central user interface 106, 702 provides primary control of the heating zones. An exemplary user interface 106 as depicted in FIG. 1 may have 3 buttons, one for general ON/OFF and one for each of the two heating elements. Pressing the button for a heating may, for example, toggle the heat through a plurality of different settings, such as for example, the following 5 such settings as a percentage of full heat generation capacity: 75%/100%/0%/25%/50%. The controls may have, for example, an LED stripe to indicate the set power and a multi-color indicator light to indicate the battery rough status (e.g. red=on; orange=charging; green=fully charged, etc.).

Figure 7:
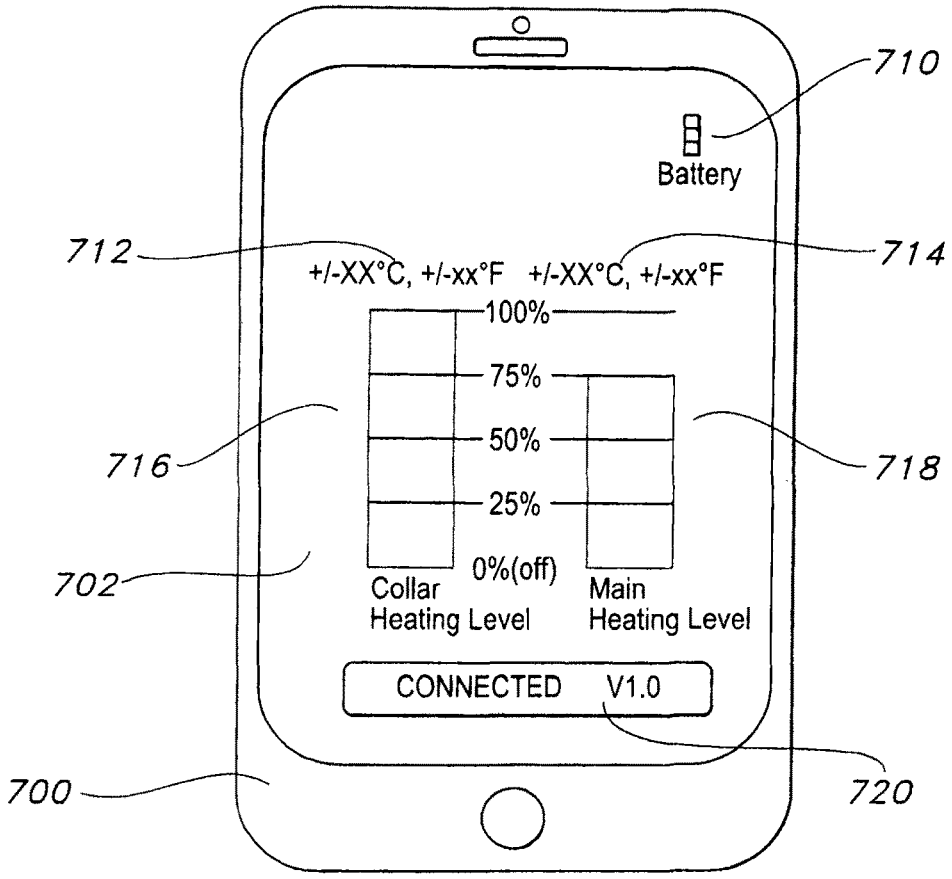
FIG. 7 is a depiction of an exemplary mobile device displaying an exemplary screen shot on the mobile device corresponding to an exemplary software application accessible from the mobile device.

Once the jacket is switched "ON," it can be connected to a mobile phone via a Bluetooth connection. An exemplary app interface is depicted in FIG. 7. This connection can be used in combination with a phone application. The phone application allows the user a second means to control settings of the jacket. Via the User App the control functions can be extended. For example, the app may permit a finer granularity of heat setting control, and the temperatures as monitored in the jacket can be displayed, and battery status (e.g. percentage of charge) can be integrated more precisely. One screen of an exemplary mobile device application software user interface 702 as depicted on the mobile device 700 may include, for example, a battery charge reading 710, actual temperature readings 712, 714 for first and second heating zones, visual displays 716, 718 showing the heat setting as a percentage of full power, and a connection reading 720 to confirm that the mobile device is paired with the wireless communications module 122 embedded in the jacket. Both the jacket-based controls and the mobile-app-based controls may function in parallel and synchronize their information and settings. Additional safety functions may be implemented in the heating elements, as described later herein.

The heating elements may, for example, comprise bundles of stainless steel wires, such as braided or woven wires known in the art or of "litz" wires (Elektrisola, Eckenhagen, Germany). The wires may be laid down on a textile support material, such as polyamid (PA) or polyester (PES), and fixed with stitches. The thin stainless steel wires behave as textile fibers due to their thin diameter. Suitable wires may comprise, for example, flexible and durable stainless steel filament yarn products made by Bekintex, Wetteren, Belgium. The invention is not limited to any particular type or materials of construction for the heating element, however, and may feature any type of heating element suitable for use in a garment. For example, alternative heating elements based on conductive polymers or inorganic conducting layers may be used, without limitation.

As is known in the art, a "litz" wire may be known by one of two definitions. In a first embodiment, a "litz" wire refers to a type of cable used in electronics, typically to carry alternating current and designed to reduce the skin effect and proximity effect losses in conductors used at frequencies up to about 1 MHz. Such litz wires are comprised of many thin wire strands, individually insulated and twisted or woven together, following one of several carefully prescribed patterns often involving several levels (groups of twisted wires are twisted together, etc.). This winding pattern equalizes the proportion of the overall length over which each strand is at the outside of the conductor. Generally, such wires comprise a copper-silver blend. As is known in the art, this type of wire provides a relatively high level of safety, because if one of the strands breaks, the resistance goes up without creating a hot spot. In a second embodiment, the term "litz" originates from the German word Litzendraht (coll. Litze), a term used to refer to any type of braided/stranded wire or woven wire, generally. Stainless steel wires conforming to this definition are highly flexible and more robust that any copper blend and therefore have certain advantages. As used herein, the term "litz" wire encompasses both definitions, although regardless of wire type used, the current provided to the wires is typically DC current, rather than AC current, although the invention is not limited to use with a particular type of current.

Using wire heating elements may cause hot spots in which the resistance of a certain area is high compared to the rest of the serial heating circuit. Contact points between materials may create such a hot sport. Such a hotspot may occur where there is a partially destroyed insulation on the litz wires or a partial breakage of a stainless steel wire. As a typical lower cost heating wire or a stainless steel wire does not contain insulation between each single wire in the bundle, a single local hot spot cannot easily be found with a resistive measurement without load. One aspect of the invention comprises a novel means to detect such a defect.

In one embodiment, depicted in FIG. 5, heating elements 500, 502 each contain an additional wire 510, 512 that may be highly resistant in nature, non-insulated, and made from a material with a high corrosion resistance. Wire 510, 512 may be connected to the main heating loop 500, 502 at approximately half the distance of the loop, as shown in FIG. 5, to sense the voltage at this position. Where the interconnect is exactly at the half distance, it will read an electrical potential at approximately half the supply voltage. When one of the half loops shows signs of degradation under load, the half point voltage shifts. This means of detection is far more sensitive than a current measurement or a resistive measurement at the two ends of the heating wire that forms the heating element. This lesser sensitivity of resistance measurements at the two ends can be explained by simulating a wire with an infinite number of serial single resistors. In such a circuit only the average resistance of the total series can be measured. Although preferable to provide enhanced sensitivity, the invention is not limited to the presence of this or any other single feature as described herein, and garments may be provided with fewer than all of the novel features herein described. Furthermore, this type of detection circuit is not limited to use in a jacket as described herein, but may be useful in any type of garment or other item typically having a textile or fabric construction, such as in a heated rug for a bathroom or in a car seat heater, for example. In particular, the circuit may be useful for embedding in any fabric object comprising a flexible, substantially planar sheet, that is used for providing heat to a surface, such as wall paper (which term includes any material suitable as a wall hanging, not limited to "paper" made from wood or other natural fibers, and may include any sheet goods made from any type of material for being disposed on a wall), rugs, bath towels, and the like.

Finally, although described as being at a half distance in the loop, it should be understood that the sense wire can be connected at any location, not limited to exactly or even approximately the half point, and implementations anywhere between one third and two thirds of the total loop distance may be optimal, although again without limitation to any particular location.

Another sense wire embodiment, depicted in FIG. 6, may comprise a sense wire 610 that is not in contact with the main heating wire 600, 602, but placed in parallel to and within a small distance of this heating element. This sense wire embodiment again may comprise highly corrosion resistant material and its electrical potential may be monitored. Under normal conditions this additional line is floating, but can be energized against ground or the supply voltage. If the heating loop has a leakage current (in case of moisture or a faulty insulation) the sense wire will be energized via the leakage current. The measurement circuit to detect such phenomenon may comprise either a simple voltage measurement or a more sophisticated circuit that can polarize the serial heating wire against ground (or negative bias voltage) or supply voltage ($V_{CC}$) (positive bias voltage) and measures the resulting current in the sense wire as additional information.

Thus, one aspect of the invention comprises a "heating element" (or any power carrying litz wire, or stainless steel wire for example) with an integrated sense wire. The following examples are not limited to a weave in combination with a conductive wire, but are illustrated below as examples:

i) In one implementation, depicted in FIG. 5, the heating circuit may comprise a textile weave in which, for example, each heating loop 500, 502 comprises two low resistance (heater wires) wires 500*a*, 500*b*, 502*a*, 502*b*, and at least one additional strand 510, 512 is higher resistance. The two heating strands are connected to an electronic control unit 520 at one end and to each other at the other end. The sense wire is woven in between the two heating wires. The sense wire is connected at the one end to the electronic control unit and at the other end to the interconnect between both wires. This interconnection can either be high or low resistance. With a voltage measurement, the consistency of the heating wire can be determined. With additional electronics control means for example, and in case of a high resistance interconnection point, electrical potential in the sense wire against positive or negative voltage can be detected and may represent a leak current in the driving elements. This is done while both ends of the heating elements are in the electrical state of either GND or $V_{CC}$, and the sense wire is set to the opposite electrical state. If the current measured in the sense wire is bigger than determined through the high resistance interconnect point, it is a leakage current.

ii) In another implementation depicted in FIG. 6, the heating circuit comprises a textile weave, in which, for example, a first heating loop 600 comprises two low resistance strands (heater wires) 600*a*, 600*b* and two additional strands 610*a*, 610*b* are higher resistance. (Similarly, second heating loop 602 comprises two low resistance strands (heater wires) 602*a*, 602*b* and two additional strands 612*a*, 612*b* that are higher resistance.) The two heating strands 600*a*, 600*b* are connected to an electronic control unit 620 at one end and to each other at the other end (located in approximately the middle of heating loops 600). At least one sense wire 610 is woven in between and parallel to the two heating wires 600*a*, 600*b*. As shown in FIG. 6, sense wire 610 comprises two wires 610*a* and 610*b*, which are connected at one end to electronic control unit 620 and at the other ends to each other (approximately adjacent where heating wires 600*a*, 600*b* connect to one another). This additional sense loop 610 can now be polarized (high resistance) opposite to the heating loop, such that if a leakage in one of the other strands 600*a*, 600*b* (that form the heating loop) is present (due to moisture or faulty insulation), the leak can be measured by the sense wires. The advantage of the introduction of 2 sense wires 610*a*, 610*b* in a loop arrangement is the possibility to test consistency of the sensing loop 610. With this consistency test, a failure of the sense wire can be detected, providing a higher safety level, as explained below.

iii) As with option (ii), above, the sense loop 612 may be connected with an active electronics unit 630 at the end opposite the main electronic control unit (that drives the heater) 620. The main control unit 620 can decide if the active electronics unit 630 at the opposite end switches the interconnect to a high resistance interconnect (typically Mega-Ohms) or to a low resistance connection (typically <1 Ohm). In the case where this interconnect point is highly resistant, it provides the opportunity to sense or measure moisture. In the case in which the interconnect point is low resistance, a self-test of the sense wires 612*a*, 612*b* can be performed. A moist textile in a normal environment (i.e. not a cleanroom with specific controls) has a lower resistance per square than a dry textile support. Long wires affixed to a textile support (and even in air) next to each other represent a moisture detector; in some cases moisture may even be measured. In use on a wearer's body, sweat may penetrate into the garment, sweat having an even lower resistance than just water, due to its salt content. The textile environment is very harsh, and because the exemplary sensor element is not insulated, even highly corrosive-resistant materials can be attacked and lose their conductivity. In such cases, a self-test is useful to avoid missing a high moisture scenario due to a failure in the sensing wire. A combination of such self-test with a measurement of the consistency of the main heating wire may also be provided. The moisture sensor design is not limited to any particular configuration, and may be provided in a textile weave as well as in a loop arrangement in which the conductive wires are laid down and stitched into a textile.

Of industrial interest may be an implementation in which the sense wire is, for example, one insulated "litz" (single or multiple metal fibers) of a litz wire bundle and simply one of several wires in the litz wire bundle. At the half (or other desired distance) point the litz wire bundle, the insulation on the sense wire may just be opened so that it electrically connects to the other wires in the bundle. Such an implementation represents a cost-effective way to manufacture such a sense circuit.

Another implementation of industrial interest may be an implementation comprising a litz wire bundle comprising a plurality of insulated litz heater wires bundled together with an uninsulated sense wire in the same bundle. Each of the heater wire and the sense wire may comprise a single metal fiber, or a plurality of metal fibers. In this implementation, if any of the insulated heater wires leaks current, the uninsulated sense wire detects the leakage. Such an implementation represents another cost-effective way to manufacture such a sense circuit.

The control of the temperature in one embodiment may be provided via a negative temperature coefficient (NTC) temperature thermistor element 540, depicted in FIG. 5. Other methods of sensing temperature may be provided, such as with the use of nano materials. Such materials may be realized in a form that the response to a temperature change is strongly non-linear, such as, for example, the behavior of a polymeric fuse, which may be self-healing after detection and shutdown in response to a hot spot. Such phenomenon can be used to detect a hot spot in a heating wire of the element. If a textile or quasi-textile (a non-textile that comports as a textile) wire is equipped on its outer surface with such temperature sensing material that shows a strong non-linear temperature behavior in temperature change, a hot spot along the line can be detected. Such a wire may be realized for a specific operating point (e.g. 106 degrees Fahrenheit). If the non-linear spot dominates the resistance of the overall wire resistance over the whole length, the associated control unit can determine that there is a hot spot in the heating area of the heating wire or heating element and shut down the heating feature. A second means to realize such a hot spot sensor is to introduce into the heating litz wire, a single metallic wire, or two as a pair (optionally twisted) with a high resistance coating. This coating melts or loses its insulation properties at a set temperature and so indicates a hot spot along this compound of materials. Such a wire could as well be used on top of a surface area heating element (as for example a deposited organic or inorganic conductive material on a substrate).

Figure 4A:
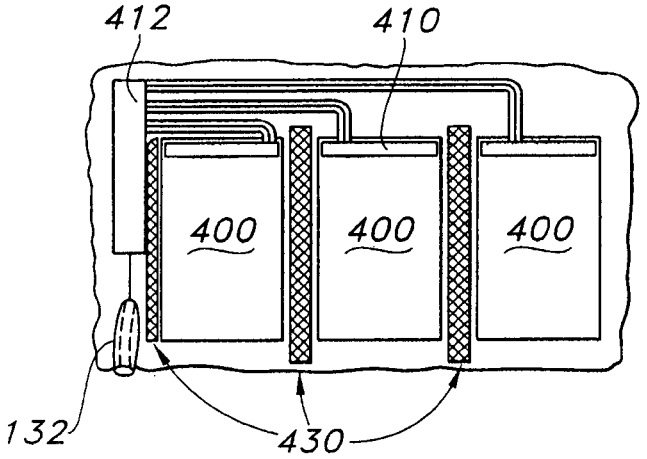
FIG. 4A is a side view depiction of an exemplary battery pack.
Figure 4B:
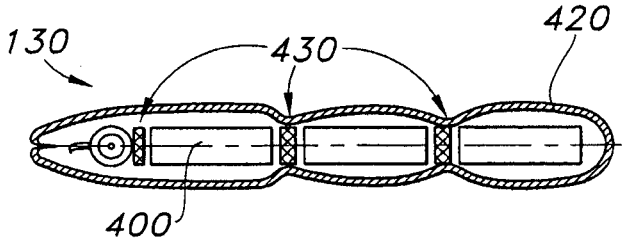
FIG. 4B is an exemplary top view depiction of the exemplary battery pack of FIG. 4A.

The main control electronics may comprise standard electronics known in the art to monitor outgoing current. The heating control 520, 620, for example, may use pulse width modulation. A current monitor enables the device to perform a self-check and test the heating devices on fatal errors. The electronics system is designed such that a maximum heating power is obtained while connected to a car power supply with an incoming voltage (such as, typically 13.7 V). In preferred embodiments, the operating voltage may be in the range of 9 to 14V. This enables on one hand seamless operation for batteries with different charging levels and the car usage scenarios discussed herein. On the other hand it intrinsically lowers the power of the heating Batteries The power supplies 130 may comprise a combination of 3 Li-Ion rechargeable batteries 400, as depicted in FIGS. 4A and 4B. For example, one preferred configuration may be a 3S 1P (3 serial, 1 parallel) design. Each power supplied contains its own charging electronics 410 and each battery 400 in the pack has a safety interconnect circuit 412. In the exemplary jacket depicted in FIG. 1, the batteries are located in both sleeves and serve as a pair. Two battery packs are preferable to provide adequate power to the heating elements for a sufficient period of time when the jacket is not electrically connected. The invention is not limited to any number or strength of batteries in a battery pack, nor limited to a battery power supply.

Each battery pack 130 may be integrated into the jacket and have its own charger 134 within the jacket that connects to a mating charging cord 132 connected to the battery pack, but the battery can also be removed for charging. The charging function can be provided by a standard serial charging technique or, more preferably, by a more complex charge balancing techniques as are known in the art.

In a preferred embodiment, the battery packs are integrated with intelligent controls 410 to permit running the jacket with a single charged battery pack and to prevent battery packs connected to the jacket from abruptly exchanging energy with one another. Thus, for example, while the charges between one battery and another may exchange over time until equalization, the power controller provides sufficient control to prevent a sudden direct energy exchange without control, that could, for example, lead to a fire or other undesirable overheating. In the preferred embodiment, the battery pack with more charge will be discharged until both are on the same voltage level and then the discharge rate will be equal after some time. The same cables in the system are preferably used charge and discharge of the battery packs. While described herein with two battery packs, the invention is not limited to any type or number of power sources.

In one embodiment, each battery pack contains its own charging circuit 410. The main heating electronics can enable or disable the charging of the battery packs. This allows for charging when the heating elements are switched to OFF. It also prevents drawing too much energy out of a car 12V plug, such as when two jackets are connected to the car. For this scenario, the absolute current drawn by each jacket may be limited to approximately 5 A in operation. This allows the jacket to charge the batteries in an intelligent manner without taking them out of the jacket. A standard DC Power supply with 13.7V output voltage can be connected to the battery packs instead of the car plug. The location of the intelligent power controller in the system is not as important as the communication ability provided by the intelligent power controller—the central electronics (or a battery) may provide the desired level of control. And, such power control is not limited to heating applications. Such controls may be of interest, for example, in military garments, and may be used to provide "intelligent" power management in a system having several batteries. An advantage of the described system is that batteries are "hot" swappable in that the device can remain in electrical operation while replacing one battery pack after another without losing power at any point in time and without an abrupt energy exchange. Other implementations may comprise diodes, but intelligent batteries are more energy efficient because they use power transistors, not diodes. In one embodiment, for example, the batteries may incorporate a LM5050-2 High Side OR-ing FET Controller, made by Texas Instruments, the specification and schematics for which are hereby incorporated by reference. The subject FET Controller in the battery back may be used in conjunction with a second MOSFET in the jacket, which is integrated with a charging circuit and in communication with the power control system, to permit charging through the same FET Controller.

Figure 9:
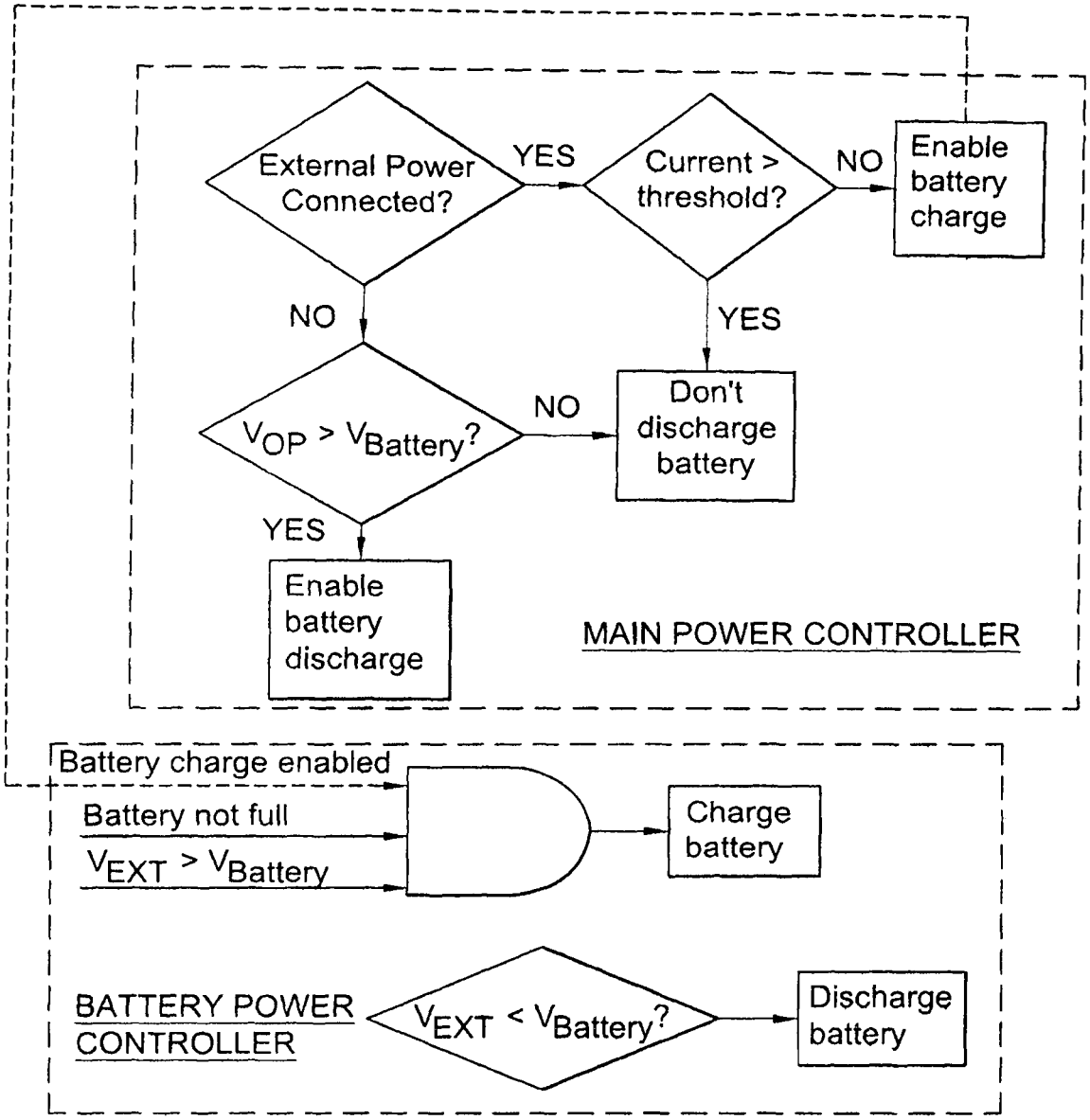
FIG. 9 is a flowchart depicting the logic of an exemplary power control system.

Logic for an exemplary power controller system is depicted in FIG. 9, which logical functions may be provided by programmable or non-programmable electronics as are known in the art. The exemplary logic essentially monitors the voltage inside each battery $V_{Battery}$ and compares it to the nominal operating voltage in the system $V_{OP}$. If the battery voltage is sufficiently high to provide power to the system, the battery is enabled for discharge. If the system voltage is higher than the battery (such as if external power is connected or if another battery has a higher potential) and the system is drawing power for heating (i.e. the current drawn is higher than a specific threshold), the batteries are not enabled to charge. If the current is below the specified threshold (i.e. the heating elements are off), the batteries are enabled to charge. The amount of total power being drawn from the power supply may be limited by the threshold such that the jacket will not draw more than a desired amount of electricity, for any number of reasons. The logic controller at the battery opens the battery to charge only when it is enabled by the main controller, when the voltage is higher than the internal voltage in the battery, and when the battery does not have a full charge. If the battery detects an actual external voltage $V_{EXT}$ lower than the battery voltage $V_{Battery}$, it discharges. When the main controller detects that the system supply voltage (that may come from the batteries) is too low, it cuts off the system, thus causing discharge to stop. When two batteries are connected with equal voltage, their voltage is slightly higher in each battery than in the system, so both will discharge. When one battery has a much higher voltage than the other, the safety circuit in the other battery will not permit it to discharge, because it will detect a $V_{EXT}$ higher than the voltage in that battery. Although shown with exemplary logic for one methodology of providing power control, it should be understood that additional logic in the main power controller or in the batteries may provide additional factors that control charging or discharging of the batteries, and that the logical decisions may be distributed among more than or fewer than the number of controllers described herein.

Prior art jackets with electronic features typically require disconnecting the battery from the jacket for charging. Although disconnecting and charging outside the jacket is possible as well in the embodiment described herein, charging without disconnecting is preferably also possible. The implementation described herein allows for charging while the user wears the garment, such as when in a car without active heat. Each jacket is configured with power connectors 140 to permit it to be plugged in to a power supply in either the left or the right lower pocket of the jacket. This allows for 2 people with such jackets to connect to the car power outlet located in the middle, no matter if they sit in the left or right side of the car.

The ability to make a hot swap of batteries is also an advantageous feature. That is, the two batteries can be swapped individually or replaced with full batteries, if the user has multiple sets.

The structure of the battery pack is such that it contains several (in an exemplary case, three) individual battery cells 400. These cells 400 are connected together and packaged in a common outer layer 420. The distance between each cell in the pack, filled by a flexible spacer 430, allows the overall structure to bend. In the described textile application the battery conforms to the human body. The flexible battery pack is placed in a pocket in the upper arm on each side of the jacket. The pocket contains an electrical connection to the jacket harness. The battery is inserted into the pocket and bends around the upper arm. The single cells are preferably oriented such that the longer dimension of a single cell is oriented along the length of the arm, with the thinner dimensions of the battery cell in the direction of the circumference of the arm.

In a preferred embodiment, the batteries are "worn" in pockets located in the upper arm, which may be useful in applications other than in jackets. The wearer generally does not perceive the low weight of the batteries (each battery pack may, for example, weigh approximately 150 g) on the upper arm as "disturbing."

The jacket is preferably powered by a central power supply. The batteries (or the external supply) deliver power though the textile harness to all the components. A centralized 5V Regulator distributes the % V power to the different components that require a 5V supply Voltage.

Textile Harness

Referring now to FIG. 8, the jacket preferably contains a textile wiring harness 800 that is integrated into the inner layer of the jacket in an unobtrusive manner. This harness connects the different electronics elements. The harness may have capability of detecting leakage currents to ensure safety of the respective garment, as described herein. Although exemplary powered components are depicted in FIG. 8, it should be understood that any powered component disclosed herein for embedding in the garment or other fabric object may be electrically connected to or otherwise powered by the harness, and may communicate with other components via signals transmitted and received through the harness. As described elsewhere herein, the harness may be optimally configured as a serial bus configured to transmit both power and informational signals to and from the various components connected thereto.

The harness preferably comprise woven metallic bundles of litz wires, as described herein. These bundles are robust enough to remain functional during the life time of the jacket. The total length of wires may be in the range of 12 m per jacket. For example, the wire bundles may comprise 2-, 4-, 6- or more-than-6-strand textile wires. The textile wires preferably comprise a woven construction comprising multiple strands of litz wires embedded into the garment in the weaving process. These litz wires can be low- or high resistance, insulated or non-insulated.

Controls

In one embodiment, the garment contains several interconnected electronic units. One embodiment comprises a heating control unit 808 that governs and coordinates the activities within all electronic modules in the garment. Signals between the electronics elements may be transmitted via the harness 800. One embodiment comprises a bus structure within the garment in which the bus structure combines different electronics units in a network. Such a bus structure may provide on one hand power and on the other hand the ability to send serial data over the bus. The serial data is such that the data packet contains an identifier, to identify the receiving module to which the data packet is addressed, and a payload section, that contains data to exchange or commands. A bus implementation may permit each separate heating element to be connected to its own active control unit, so that a central control interface can send serial data over the bus to activate or deactivate the different electronic control units. Diagnostic and sensor data may be exchanged as well and may be communicated over the same signal lines as commands. Such a bus system allows for a more flexible implementation of a garment with many functions.

Actuators, sensors and control elements, as well as communication means (for example RF receivers with antennas) and power harvesting or supply elements may be connected to the same bus structure and interact as a system. The variety of sensors and the complexity of the complete system may be varied, as the interconnect points may always be similar and the production of elements may be the same for different type of systems, as long as there are common elements. As one, non-limiting example, the various electronic components discussed herein may be connected to bus 800, including power supplies 802, power controllers 804, heating elements 806, heat controllers 808, wireless communications module 810, user interface 812, and various charging lines 814 for inputting or outputting power to accessories, phones, etc.

In a jacket embodiment, the bus structure may facilitate realization of more heating zones easier in production management of a variety of garments with slightly different functions.

Charger

A charging function, such as for mobile phone 700, may be provided via a standard USB plug 114 as an interface. A phone-specific charging cable (not shown) can then be used for connecting to the jacket. The jacket will optimally provide, for example, 5V and a maximum of 1 A load current, although it is not limited to any particular type of interface or electrical characteristics. The jacket is preferably protected against the connection of an overly large load such that the power controller 804 may limit the voltage if the load current exceeds a certain threshold, such as, for example, 1 A. An over-temperature control, such as one comprising temperature sensors and a logic controller, preferably shuts down power in case of overheating of the charger.

Bluetooth®

Jacket may have speakers 110 and microphone 112 integrated into the jacket with a link, such as via Bluetooth® technology, to a cell phone 700 for hands free operation. Speakers 110 may be optimized for speech playback and located in the collar relatively close to a wearer's ears, so that the system provides acceptable sound quality even with loud surrounding noise. Microphone 112 integrated into the inner collar 103 senses the voice of the user and also may be selected to provide good sound quality even when being used in a moving vehicle with the top down. Microphone 112 is optimally placed in the garment so that it is positioned close to the vocal cords and just above the throat to sense the speech of the user. The inner wool collar 103 serves as a filter and protects the microphone from wind noises. Especially when the collar is closed with the zipper of the jacket, the microphone is close to the throat and has a good sensing position. A charger 114 is optimally located in the pocket for connection to and charging of the phone. Such a hardwired connection can also provide the communications link to the phone, instead of or as an alternative to using a Bluetooth® connection.

The exemplary Bluetooth® system is based on, for example, a BT4.0 and BT4.1 compatible chipset and provides on one hand Bluetooth® low energy connectivity and on the other hand a BT functionality with hands free and Advanced Audio Distribution Profile (A2DP) protocols. These protocols may permit hands free calls (with a reduced user interface) and to stream music. Further, Bluetooth connectively allows a control of the functions via the mobile phone application described herein, by permitting monitoring information from temperature sensor elements in the jacket to the application.

One embodiment may comprise an on-jacket user interface 120, as depicted in FIG. 1, and the Bluetooth® electronics may be located in wireless communications module 122, for example, located in the upper left sleeve adjacent battery 130, such as in the battery pocket. The buttons on the user interface 120 are preferably disposed so that they align with stitched circles in the upper sleeve and can be sensed easily with the fingers without looking.

Warm Thoughts

As an optional feature, the jacket may be integrated with the related mobile app to give to a user "warm thoughts" under certain circumstances. For example, a user may register a VIP (very important person) via the mobile software app such that the jacket provides an alert when this VIP sends an email, SMS message, and/or calls. For example, an SMS containing information about the user prompts a specific heat pattern (such as a multi zone heat pattern with timed heat responses) when the message from such VIP comes into the phone. The SMS may be linked to a specific patterns, analogous to a specific ringtone set for a specific caller, or the SMS may contain information that prompts the specific pattern. A heat response is just one example of possible responses of the jacket, as the jacket could also play a special signal through the speakers, blink a special lighted pattern with the indicator light or lights, or the like.

With this feature, a friend that is registered as VIP in the control settings of the phone application, can send an SMS. The jacket indicates to the user of the jacket, via a signature gentle heating pattern, that the VIP has sent "warm thoughts."

Although described in connection with a specific example of "warm thoughts," this aspect of the invention is not limited to such an implementation, and may be embodied by any garment or other fabric object configured to provide any visual, audible, tactile, or otherwise wearer- or user-perceptible response when prompted by a command received from a first mobile device in communication with a controller configured to enable such a response, particularly a command sent by the first mobile device in response to a message received over a communications network from a second mobile device.

The "Signature Sign"

The signature sign is a source indicator (branding device) comprising a special ornamental pattern of lights that light up in a characteristic sequence when the jacket is powered and switched ON. For example, the characteristic sequence may be to glow and light up every 15 seconds. The signature sign is preferably fixed to the outer leather of the garment and the light resides behind stitched dots. The LEDs are connected to the main heating electronics and controlled via pulse width modulation.

The single or multiple LEDs, such as the 2 LEDs shown in FIG. 1, are preferably covered by a black mesh fabric (or any color desired to be visible when the LED is not lit), such that the appearance of the dot is black (or other color) when the LED is unlit. Without the mesh, the appearance would be white or yellow rather than a black dot. This is in particular of interest in leather garments or garments with a thicker outer fabric layer where the light would not shine through and a hole has to be opened to allow the light to penetrate the fabric.

The particular construction comprises 2 LEDs that are assembled on an electronic substrate (flexible or stiff, the LEDs can be on the same substrate or on separate ones). This substrate is connected to a textile wire that is connected to an electronic control unit and a power supply. A mesh fabric may be positioned between the substrate and the LEDs.

Above the LEDs a hole is punched into the outer layer. The substrate is fixed (e.g. glued or stitched) to the inside of the outer layer and permanently attached.

As depicted in FIG. 1, the signature sign comprises two LEDs that form the dots in an "ii" logo that serves as an indicator of source of an exemplary. It should be therefore understood that the function of providing a visual cue that the jacket is "on" can take any form, and that the provision of more than one light, use of a specific pulse pattern, and locations of the lights on the garment and relative to one another, may all comprise source indicators specific to a particular brand. Thus, the signature sign may comprise a stand-alone device—affixed to a textile outer layer of a garment, T-shirt or any other textile construction. In particular, the device may be a part of the same process control block for the rest of the jacket (fixed with a short interconnect wire or cable or additional substrate) or it may derive power from an energy harvester. For an energy harvester, kinetic energy or thermal differential energy may be particularly useful. For example, a wireless coil may harvest energy from a surrounding electromagnetic field and store that energy in a capacitor or a rechargeable battery.

The ornamental design of two lights spaced apart from one another and juxtaposed as dots on the double-i's of the logo and the characteristic interval of glimmering on and off of these lights are purely ornamental features of the jacket. While it is known to use a light, or even a pulsed light, to functionally indicate that an electronic device is on, which function is also served by the lights discussed herein, having two lights lit in unison slightly spaced apart from one another, juxtaposed as dots on lowercase i's and glimmering on and off in a particular frequency, rather than constantly on, is one of an infinite number of possibilities for carrying out this function. Thus, the visual on-indicator feature may be provided by a single light or any number of lights in any ornamental pattern and is not limited to the particular ornamental pattern discussed herein.

The indicator light or lights may be controlled by a controller programmed or otherwise configured with different functional indicator patterns to notify the user that, for example, the jacket is charging, running out of battery, or that an incoming call is being received. Such functional aspects, however, can be served by a single light or any pattern of lights, not limited to the specific ornamental pattern depicted herein.

Types of Garments

The wearable garment described primarily herein comprises a leather jacket comprising a plurality of features. It should be understood, however, that the inventions discussed herein are not limited to any particular type of garment, nor are any particular types of garments, including leather jackets, limited to any particular combination of features. Exemplary garments may comprise any permutation and combination of features, including fewer than all of the features discussed herein, and including only one of any of the novel features discussed herein, any of which may be in combination with other functions or features, including those known in the art and/or novel features not disclosed herein.

To the extent that electronic and logical features are discussed herein, it should be understood that any type of controllers, such as for example programmable microprocessors, and electronic components known in the art, such as but not limited to integrated circuits "hard wired" to provide the disclosed and claimed logical features, may be used to create the functionalities discussed herein, and that any such components for which examples are given do not limit the invention to such components. Furthermore, to the extent exemplary beneficial uses of the garment are described for illustration, the invention is not limited to garments for any particular uses. Finally, each of the novel configurations discussed herein should not be construed as limited only to wearable garments. For example, and without limitation, certain aspects of the invention related to heating wires, leak or humidity sensing, and the like, may be relevant to applications not associated with garments, such as for example, in vehicle seat heating, electric blankets, or any applications for such devices and related electronics. Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A garment or fabric article comprising an electrical system embedded in the garment or fabric article, the electrical system comprising:

an electrical bus;

one or more powered components connected to the electrical bus;

at least two removable power sources electrically connected to the one or more powered components via the electrical bus, each power source comprising an on-board charging circuit;

an input for connection to an external power source other than the at least two removable power sources, wherein each of the at least two removable power sources is rechargeable and configured to receive a charge from the external power source without removal of the at least two removable power sources from the garment or fabric article;

at least one controller electrically connected to the at least two removable power sources, the at least one controller comprising at least two circuits, each circuit connected to one of the at least two removable power sources via the electrical bus, each circuit comprising a switch activated to permit the connected removable power source to discharge only when voltage outside the connected removable power source is lower than inside the connected removable power source as determined by a logical voltage comparative function of the controller, the controller configured (a) to prevent an uncontrolled exchange of power or facilitate a controlled exchange of power between the at least two removable power sources when each has a different electrical potential from the other, and (b) to permit a continuous supply of power to the electrical bus (i) when fewer than all of the at least two removable power sources are disconnected and (ii) during connection or disconnection from the external power source.

2. The garment or fabric article of claim 1, wherein the at least one controller is configured to control whether each of the at least two removable, rechargeable power sources charges or does not charge when connected to the external power source.

3. The garment or fabric article of claim 1, further comprising at least one light electrically connected to the at least two removable power sources and operable to blink in a characteristic pattern when the one or more powered components is operating.

4. The garment or fabric article of claim 1 further comprising a communications module connected to the controller and operable to share information with a device communicatively paired to the communications module, the information comprising a command instruction transmitted from the device to the controller for operating the one or more powered components, monitoring information transmitted from the controller to the device relating to operation of the one or more powered components, or a combination thereof.

5. The garment or fabric article of claim 4, wherein the device comprises a mobile phone, tablet or other computing device.

6. The garment or fabric article of claim 4, wherein the device is connected to a display screen configured to visually display one or more of: a battery charge reading, actual temperature readings for one or more heating zones, heat setting as a percentage of full power, and a connection reading to confirm that the device is communicatively connected to the communications module attached to the controller.

7. The garment or fabric article of claim 1, wherein the one or more powered components comprises a heating system comprising:

at least one heating element comprising an electrical resistance heating loop having a first heating loop end and a second heating loop end connected to the at least one controller;

at least one sense wire for detecting and providing a signal indicative of a safety condition relating to the electrical resistance heating loop, the at least one sense wire consisting of a wire having a first sense wire end electrically connected to the heating loop at a point between the heating loop first end and the heating loop second end and a second sense wire end connected to the at least one controller;

wherein the at least one controller is configured to shut down the at least one heating element in response to the signal from the sense wire indicative of the safety condition, the signal indicative of the safety condition comprising a change in voltage or current in the at least one sense wire.

8. The garment or fabric article of claim 7, wherein the fabric article comprises a substantially planar sheet comprising the at least one heating element, wherein the planar sheet is sufficiently flexible to conform to a planar or non-planar surface.

9. The garment or fabric article of claim 8, wherein the fabric article is selected from the group consisting of: a wall hanging, a rug, and a towel.

10. The garment or fabric article of claim 7 comprising a plurality of heating zones, each heating zone comprising at least one independently controllable heating element.

11. The garment or fabric article of claim 7, wherein the at least one electrical resistance heating loop comprises at least two heater wires, each having a heater wire first end and a heater wire second end, the at least one electrical resistance heating loop defining a path having a length between respective heater wire first ends connected to the at least one controller and respective heater wire second ends connected to each other.

12. The garment or fabric article of claim 7, wherein the at least one controller comprises at least one power controller and at least one heating system controller.

13. The garment or fabric article of claim 1, further comprising:

at least one heating element comprising an electrical resistance heating loop comprising at least one heater wire having a first end and a second end, the first end and the second end connected to the at least one controller, the heating loop defining a single sinuous path that defines an area; and at least one sensor wire consisting of a conductive member having a first end connected to the controller and a second end connected to the controller, positioned in the area defined by and disposed adjacent to the sinuous path defined by the heating loop, the conductive member configured for providing a signal indicative of the safety condition as a change in voltage or current in the conductive member.

14. The garment or fabric article of claim 13, wherein the conductive member is uninsulated and the at least one heater wire is insulated.

15. The garment or fabric article of claim 14, wherein at least one heater wire and the conductive member are provided as a bundle.

16. The garment or fabric article of claim 13, wherein the at least one electrical resistance heating loop comprises at least two heater wires, each having a heater wire first end and a heater wire second end, the at least one electrical resistance heating loop defining a path having a length between respective heater wire first ends connected to the at least one controller and respective heater wire second ends connected to each other, and the at least one conductive member comprises a first conductive member that defines a path parallel to a first heater wire of the at least two heater wires, and a second conductive member that defines a path parallel to a second heater wire of the at least two heater wires.

17. The garment or fabric article of claim 13, wherein the at least one conductive member is characterized by a resistance having a non-linear response to temperature, such that a hot spot of a predetermined temperature in the heating wire adjacent the at least one conductive member causes the non-linear response to change the resistance of the conductive member in an amount detectable by the controller, thereby providing the signal indicative of the safety condition.

18. A garment or fabric article comprising:

at least one heating element comprising an electrical resistance heating loop having a first heating loop end and a second heating loop end and defining a single sinuous path that outlines an area between the first heating loop end and the second heating loop end;

a controller connected to the first end and the second end of the at least one heating element and configured to shut down the heating element in response to a signal indicative of the safety condition relating to the electrical resistance heating loop;

at least one sensor wire consisting of a conductive member having a first end connected to the controller and a second end connected to the controller and positioned in the area and disposed adjacent to the sinuous path defined by the heating loop, the conductive member configured for providing the signal indicative of the safety condition as a change in voltage or current in the conductive member;

the conductive member characterized by a resistance having a non-linear response to temperature, such that a hot spot of a predetermined temperature in the heating wire adjacent the conductive member causes the non-linear response to change the resistance of the conductive member in an amount detectable by the controller, thereby providing the signal indicative of the safety condition, wherein the conductive member comprises a textile or quasi-textile wire having an outer surface characterized by the resistance having a non-linear response to temperature.

19. A garment or fabric article comprising:

at least one heating element comprising an electrical resistance heating loop having a first heating loop end and a second heating loop end and defining a single sinuous path that outlines an area between the first heating loop end and the second heating loop end;

a controller connected to the first end and the second end of the at least one heating element and configured to shut down the heating element in response to a signal indicative of the safety condition relating to the electrical resistance heating loop;

at least one sensor wire consisting of a conductive member having a first end connected to the controller and a second end connected to the controller and positioned in the area and disposed adjacent to the sinuous path defined by the heating loop, the conductive member configured for providing the signal indicative of the safety condition as a change in voltage or current in the conductive member;

the conductive member characterized by a resistance having a non-linear response to temperature, such that a hot spot of a predetermined temperature in the heating wire adjacent the conductive member causes the non-linear response to change the resistance of the conductive member in an amount detectable by the controller, thereby providing the signal indicative of the safety condition, wherein the conductive member comprises one or more wires having a coating configured to melt or undergo a change in insulation properties at a set temperature to indicate a hot spot.

* * * * *